US005256321A

United States Patent [19]

Todd

[11] Patent Number: 5,256,321

[45] Date of Patent: Oct. 26, 1993

[54] GREASE COMPOSITIONS

[75] Inventor: Patricia R. Todd, Chardon, Ohio

[73] Assignee: The Lubrizol Corporation, Wickliffe, Ohio

[21] Appl. No.: 911,833

[22] Filed: Jul. 10, 1992

[51] Int. Cl.[5] ..... C10M 137/04; C10M 141/02

[52] U.S. Cl. ..... 252/32.007 E; 252/33; 252/41

[58] Field of Search ..... 252/18, 25, 33, 32.7 E, 252/41

[56] References Cited

U.S. PATENT DOCUMENTS

| | | | |
|---|---|---|---|
| 2,802,856 | 8/1957 | Norman et al. | 260/461 |
| 3,197,405 | 7/1965 | Lesuer et al. | 252/32.7 |
| 3,318,807 | 5/1967 | Lyons et al. | 252/41 |
| 3,341,633 | 9/1967 | Asseff et al. | 260/978 |
| 3,389,085 | 6/1968 | Morway | 252/41 |
| 4,410,435 | 10/1983 | Naka et al. | 252/42.1 |
| 4,582,617 | 4/1986 | Doner et al. | 252/32.7 |
| 4,600,517 | 7/1986 | Doner et al. | 252/32.7 |
| 4,655,948 | 4/1987 | Doner et al. | 252/49.6 |
| 4,743,386 | 5/1988 | Doner et al. | 252/49.6 |
| 4,752,416 | 6/1988 | Scharf et al. | 252/49.8 |
| 4,780,227 | 10/1988 | Doner et al. | 252/32.7 |
| 4,781,850 | 11/1988 | Doner et al. | 252/49.6 |
| 4,828,732 | 5/1989 | Doner et al. | 252/32.7 |
| 4,828,734 | 5/1989 | Doner et al. | 252/49 |
| 4,897,210 | 1/1990 | Newsoroff | 252/41 |
| 4,961,868 | 10/1990 | Doner et al. | 252/32.7 |
| 5,068,045 | 11/1991 | Doner et al. | 252/32.007 |
| 5,084,194 | 1/1992 | Doner et al. | 252/32.7 |

OTHER PUBLICATIONS

ISBN 0-9613935-1-3 Lubricating Grease Guide-copyright 1987.

Lubrizol Product Recommendations for Use in Greases-date unknown.

Anglamol ®99 Brochure, The Lubrizol Corp.-Jun. 1992.

Lubrizol ®885 Grease Brochure, The Lubrizol Corp-.-Nov. 1990.

Lubrizol ®5002 Industrial Gear Brochure, The Lubrizol Corp.-Nov. 1990.

Lubrizol ®5080 Component Brochure, The Lubrizol Corp.-date unknown.

Lubrizol ®5080A Component Brochure, The Lubrizol Corp.-Jan. 1991.

Lubrizol ®5034 Industrial Gear Brochure, The Lubrizol Corp. -Nov. 1990.

Lubrizol ®5034A Industrial Gear Brochure, The Lubrizol Corp.-Nov. 1990.

*Primary Examiner*—Jacqueline V. Howard

*Attorney, Agent, or Firm*—Joseph P. Fischer; Frederick D. Hunter; James L. Cordek

[57] ABSTRACT

Improved grease compositions substantially free of boron and boron-containing compounds, comprise a major amount of an oil based simple metal soap thickened base grease and a minor amount of at least one sulfur and phosphorus containing composition sufficient to increase the dropping point of the base grease, as measured by ASTM Procedure D-2265 by at least 30° C., the phosphorus and sulfur compound being described in detail herein.

53 Claims, No Drawings

GREASE COMPOSITIONS

FIELD OF THE INVENTION

This invention relates to grease compositions. More particularly, it relates to metal soap thickened base greases having dropping points increased by at least about 30° C. as measured by ASTM Procedure D-2265.

BACKGROUND OF THE INVENTION

Man's need to reduce friction dates back to ancient times. As far back as 1400 B.C., both mutton fat and beef fat (tallow) were used in attempting to reduce axle friction in chariots.

Until the mid-1800s, lubricants continued to be primarily mutton and beef fats, with certain types of vegetable oils playing minor roles. In 1859, however, Colonel Drake drilled his first oil well. Since that time most lubricants, including greases, have been based on petroleum ("mineral") oil, although synthetic oil based lubricants are used for special applications.

In the *NLGI Lubricating Grease Guide*, C 1987, available from the National Lubricating Grease Institute, Kansas City, Mo., USA, is a detailed discussion of greases, including various types of thickeners. Such thickeners include metal soap, complex metal salt-metal soap and non-soap thickened greases.

Metal soap thickened greases have provided exemplary performance. However, under certain conditions an increased dropping point as measured by ASTM Procedure D-2265 is required.

One way to increase the dropping point of base greases is to convert a simple metal soap grease to a complex grease by incorporating therein certain acids, typically carboxylic acids such as acetic acid, alpha-omega-dicarboxylic acids and certain aromatic acids. This process necessarily consumes considerable time resulting in reduced production.

Doner et al, in a series of U.S. Patents, specifically, U.S. Pat. Nos.

| | | |
|---|---|---|
| 5,084,194 | 5,068,045 | 4,961,868 |
| 4,828,734 | 4,828,732 | 4,781,850 |
| 4,780,227 | 4,743,386 | 4,655,948 |
| 4,600,517 | 4,582,617 | |

teaches increased thickening of metal salt thickened base greases is obtained employing a wide variety of boron-containing compounds. Other additives contemplated for use with boron-containing compounds are phosphorus- and sulfur-containing materials, particularly zinc dithiophosphates.

Reaction products of O,O-dihydrocarbylphosphorodithioic acids with epoxides are described by Asseff in U.S. Pat. No. 3,341,633. These products are described as gear lubricant additives and as intermediates for preparing lubricant additives.

U.S. Pat. No. 3,197,405 (LeSuer) describes phosphorus and nitrogen containing compositions prepared by forming an acidic intermediate by the reaction of a hydroxy substituted triester of a phosphorothioic acid with an inorganic phosphorus reagent and neutralizing a substantial portion of said acidic intermediate with an amine. These compositions are described as lubricant additives.

U.S. Pat. No. 4,410,435 (Naka et al) teaches a lithium complex grease containing a base oil, a fatty acid having 12–24 carbon atoms, a dicarboxylic acid having 4–12 carbon atoms and/or a dicarboxylic acid ester and lithium hydroxide thickened with a phosphate ester and/or a phosphite ester.

SUMMARY OF THE INVENTION

This invention relates to improved grease compositions substantially free of boron and boron-containing compounds, comprising a major amount of an oil-based simple metal soap thickened base grease and a minor amount of at least one phosphorus and sulfur containing composition sufficient to increase the dropping point of the base grease, as determined by ASTM procedure D-2265, by at least 30° C., said phosphorus and sulfur containing composition selected from the group described in greater detail hereinbelow.

The greases of this invention are useful for lubricating, sealing and protecting mechanical components such as gears, axles, bearings, shafts, hinges and the like. Such mechanical components are found in automobiles, trucks, bicycles, steel mills, mining equipment, railway equipment including rolling stock, aircraft, boats, construction equipment and numerous other types of industrial and consumer machinery.

DETAILED DESCRIPTION OF THE INVENTION

Heat resistance of greases is measured in a number of ways. One measure of heat resistance is the dropping point. Grease typically does not have a sharp melting point but rather softens until it no longer functions as a thickened lubricant. The American Society for Testing and Materials (1916 Race Street, Philadelphia, Pa.) has set forth a test procedure, ASTM D-2265, which provides a means for measuring the dropping point of greases. .

In general, the dropping point of a grease is the temperature at which the grease passes from a semisolid to a liquid state under the conditions of the test. The dropping point is the temperature at which the first drop of material falls from the test cup employed in the apparatus used in ASTM procedure D-2265.

For many applications simple metal soap thickened base greases are entirely satisfactory. However, for some applications, greater heat resistance manifested by a dropping point above that obtained employing simple metal soap thickened greases is desirable.

Complex metal soap greases provide increased dropping point, but have a number of significant drawbacks. Complex thickeners involve in addition to a fatty acid component, a non-fatty acid, e.g., benzoic, organic dibasic acids, etc. component. The formation of the complex grease typically requires extended heating periods, sometimes several times that required to prepare a simple metal soap thickened grease. Accordingly, it is desirable to provide a means for preparing a simple metal soap thickened grease composition having dropping points approaching or even exceeding those possessed by complex greases.

Thus, it is an object of this invention to provide novel grease compositions.

It is a further object of this invention to provide grease compositions having valuable properties.

It is another object of this invention to provide grease compositions having improved thermal (heat) stability as indicated by an increased dropping point as measured by ASTM Procedure D-2265.

Other objects will become apparent to the skilled person upon reading the specification and description of this invention.

The grease compositions of this invention display dropping points at least 30° C. greater than the dropping point of the corresponding simple metal soap thickened base grease. This benefit is obtained by incorporating into a simple metal soap thickened base grease certain sulfur and phosphorus containing compositions in amounts sufficient to increase the dropping point of the corresponding base grease by at least about 30° C. as measured by ASTM Procedure D-2265.

Greases are frequently exposed to water. Thus, it is desirable that general purpose greases be substantially free of components that are readily adversely affected by water.

Boron-containing compounds are notoriously sensitive to water, either being water-soluble, being subject to leaching from the grease into water or being readily hydrolyzed yielding undesirable hydrolysis products or to hydrolysis products which readily leach out into water. Accordingly, the grease of this invention is substantially free of boron and boron-containing compounds.

The expression "substantially free of" means that the material referred to is absent or present in amounts having an essentially unmeasurable or insignificant effect on the grease composition.

Greases are typically prepared by thickening an oil basestock. The greases of this invention are oil-based, that is, they comprise an oil which has been thickened with a metal soap thickener.

The grease compositions of this invention employ an oil of lubricating viscosity, including natural or synthetic lubricating oils and mixtures thereof. Natural oils include animal oils, vegetable oils, mineral oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicone-based oils and mixtures thereof.

Specific examples of oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Base Oils", *Lubricant Engineering*, volume 43, pages 184–185, March 1987. This article is herein incorporated by reference for its disclosures relating to lubricating oils. A description of oils of lubricating viscosity occurs in U.S. Pat. No. 4,582,618 (Davis) (column 2, line 37 through column 3, line 63, inclusive), herein incorporated by reference for its disclosure to oils of lubricating viscosity.

Another source of information regarding oils used to prepare lubricating greases is *NLGI Lubricating Grease Guide*, National Lubricating Grease Institute, Kansas City, Mo. (1987), pp 1.06–1.09, which is expressly incorporated herein by reference.

The simple metal soap thickeners employed in the greases of this invention are well-known in the art. These metal soaps are incorporated into a base oil, typically, an oil of lubricating viscosity in amounts, typically from about 1 to about 30% by weight, more often from about 1 to about 15% by weight, of the base grease composition. In many cases, the amount of metal soap used to thicken the base oil constitutes from about 5% to about 25% by weight of base grease. In other cases from about 24 to about 15% by weight of metal soap is present in the base grease.

The specific amount of metal soap required often depends on the metal soap employed. The type and amount of metal soap employed is frequently dictated by the desired nature of the grease.

The type and amount of metal soap employed is also dictated by the desired consistency, which is a measure of the degree to which the grease resists deformation under application of force. Consistency is usually indicated by the ASTM Cone penetration test, ASTM D-217 or ASTM D-1403.

Types and amounts of simple metal soap thickeners to employ are well-known to those skilled in the grease art. The aforementioned *NLGI Lubricating Grease Guide*, pp 1.09–1.11 provides a description of simple metal soap thickeners. This text is hereby incorporated herein by reference for its disclosure of simple metal soap grease thickeners.

As indicated hereinabove the grease compositions of this invention are oil based, including both natural and synthetic oils. Greases are made from these oils by adding a thickening agent thereto. Thickening agents useful in the greases of this invention are the simple metal soaps. By simple metal soaps is meant the substantially stoichiometrically neutral metal salts of fatty acids. By substantially stoichiometrically neutral is meant that the metal salt contains from about 90% to about 110% of the metal required to prepare the stoichiometrically neutral salt, preferably from about 954 to about 100%.

Fatty acids are defined herein as carboxylic acids containing from about 8 to about 24, preferably from about 12 to about 18 carbon atoms. The fatty acids are usually monocarboxylic acids. Examples of useful fatty acids are capric, palmitic, stearic, oleic and others. Mixtures of acids are useful. Preferred carboxylic acids are linear; that is they are substantially free of hydrocarbon branching.

Particularly useful acids are the hydroxy-substituted fatty acids such as hydroxy stearic acid wherein one or more hydroxy groups may be located at internal positions on the carbon chain, such as 12-hydroxy-, 14-hydroxy- etc. stearic acids.

While the soaps are fatty acid salts, they need not be, and frequently are not, prepared directly from fatty acids. The typical grease-making process involves saponification of a fat which is often a glyceride or of other esters such as methyl or ethyl esters of fatty acids, preferably methyl esters, which saponification is generally conducted in situ in the base oil making up the grease.

Whether the metal soap is prepared from a fatty acid or an ester such as a fat, greases are usually prepared in a grease kettle, forming a mixture of the base oil, fat, ester or fatty acid and metal-containing reactant to form the soap in-situ. Additives for use in the grease may be added during grease manufacture, but are often added following formation of the base grease.

The metals of the metal soaps are typically alkali metals, alkaline earth metals and aluminum. For purposes of cost and ease of processing, the metals are incorporated into the thickener by reacting the fat, ester or fatty acid with basic metal containing reactants such as oxides, hydroxides, carbonates and alkoxides (typically lower alkoxides, those containing from 1 to 7 carbon atoms in the alkoxy group) The soap may also be prepared from the metal itself although many metals are either too reactive or insufficiently reactive with the fat, ester or fatty acid to permit convenient processing.

Preferred metals are lithium, sodium, calcium, magnesium, barium and aluminum. Especially preferred are lithium, sodium and calcium; lithium is particularly preferred.

Preferred fatty acids are stearic acid, palmitic acid, oleic and their corresponding esters, including glycerides (fats). Hydroxy-substituted acids and the corresponding esters, including fats are particularly preferred.

These and other thickening agents are described in U.S. Pat. Nos. 2,197,263; 2,564,561 and 2,999,066, and the aforementioned *NLGI Lubricating Grease Guide*, all of which are incorporated herein by reference for relevant disclosures of grease thickeners.

Complex greases, e.g., those containing metal soap-salt complexes such as metal soap-acetates, metal soap-dicarboxylates, etc. are not simple metal soap thickeners as defined herein.

The phosphorus and sulfur containing compositions employed in the grease compositions of the instant invention include phosphorus and sulfur containing acids, salts and other derivatives and other compounds including thiophosphite compounds. Useful sulfur and phosphorus containing compounds are described in detail hereinbelow. These compounds, when used at amounts indicated herein increase the dropping point of the simple metal soap thickened base grease into which they are incorporated by at least 30° C. as measured by ASTM Procedure D-2265. This effect is surprising since these compounds, which are normally used as extreme pressure and antiwear compounds have not been observed to have a noticeable effect on dropping point at levels normally employed to improve extreme pressure and antiwear properties. Phosphorus- and sulfur-containing compositions useful for increasing the dropping point of simple metal soap thickened base greases include (A-1) a compound represented by the formula

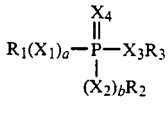

(I)

wherein each $X_1$, $X_2$, $X_3$ and $X_4$ is independently oxygen or sulfur provided at least one is sulfur; each a and b is independently 0 or 1; and wherein each $R_1$, $R_2$ and $R_3$ is independently hydrogen, hydrocarbyl, a group of the formula

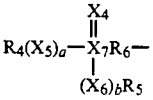

(II)

wherein each $R_4$ and $R_5$ is independently hydrogen or hydrocarbyl, provided at least one of $R_4$ and $R_5$ is hydrocarbyl, $R_6$ is an alkylene or alkylidene group, each a and b is independently 0 or 1, and each $X_5$, $X_6$, $X_7$ and $X_8$ is independently oxygen or sulfur;

or a group of the formula $R_6OH$, wherein $R_6$ is an alkylene or alkylidene group;

(A-2) an amine or an ammonium salt of (A-1) when at least $R_3$ is hydrogen;

(A-3) a compound represented by the formula

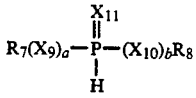

(III)

or

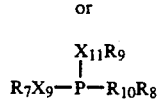

(IV)

wherein each $R_7$, $R_8$ and $R_9$ is independently hydrogen or a hydrocarbyl group provided at least one is hydrocarbyl, each $X_9$, $X_{10}$ and $X_{11}$ is independently oxygen or sulfur provided at least one is sulfur, and each a and b is independently 0 or 1; and (A-4) mixtures of two or more of (A-1) to (A-3) thereof.

In a preferred embodiment, a and b are each 1.

In one embodiment the sulfur- and phosphorus containing composition is the compound (A-1). Preferably, a and b are each 1. In one embodiment $R_1$ and $R_2$ are each independently hydrocarbyl groups containing from 1 to about 30 carbon atoms and $R_3$ is H or a hydrocarbyl group containing from 1 to about 30 carbon atoms.

In a particular embodiment, each of $R_1$, $R_2$ and $R_3$ is independently an alkyl group containing from 1 to about 18 carbon atoms or an aryl group containing from about 6 to about 18 carbon atoms, and more particularly each of $R_1$, $R_2$ and $R_3$ is independently a butyl, hexyl, heptyl, octyl, oleyl or cresyl group.

In another particular embodiment, $R_3$ is H. When $R_3$ is H it is preferred that each of $R_1$ and $R_2$ is independently an alkyl group containing from 1 to about 18 carbon atoms or an aryl group containing from about 6 to about 18 carbon atoms, and more particularly each of $R_1$ and $R_2$ is independently a butyl, hexyl, heptyl, octyl, oleyl or cresyl group.

In a preferred embodiment, each $R_1$, $R_2$ and $R_3$ is independently hydrogen or

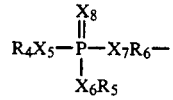

(V)

Preferably, $R_3$ is hydrogen and each $R_1$ and $R_2$ is independently hydrogen or

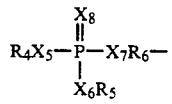

(V)

As mentioned hereinabove at least one of $X_1$, $X_2$, $X_3$ and $X_4$ must be sulfur while the remaining groups may be oxygen or sulfur. In one preferred embodiment one of $X_1$, $X_2$ and $X_3$ is sulfur and the rest are oxygen.

When $R_1$, $R_2$ or $R_3$ is a group of the formula

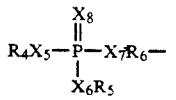

(V)

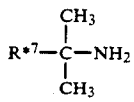

it is preferred that $X_5$ and $X_6$ are oxygen and $X_7$ and $X_8$ are sulfur, or one of $X_5$, $X_6$, $X_7$ and $X_8$ is sulfur and the rest are oxygen. In these cases preferably each of $X_3$ and $X_4$ is oxygen and more preferably $X_2$ is oxygen.

In a further embodiment each of $R_1$ and $R_2$ is independently hydrocarbyl having from 1 to about 30 carbon atoms and $R_3$ is $R_6OH$ wherein $R_6$ is an alkylene or alkylidene group containing from 2 to about 28 carbon atoms. In this case one of $X_1$, $X_2$, $X_3$ and $X_4$ is sulfur and the rest are oxygen. In a preferred embodiment, $X_3$ and $X_4$ are sulfur and $X_1$ and $X_2$ are oxygen. Also preferred is where $R_6$ is alkylene.

In another embodiment, the phosphorus and sulfur containing composition is the ammonium or amine salt (A-2). Preferably, a and b are each 1.

When any of $R_1$, $R_2$ or $R_3$ is H, the compound of Formula I is an acid. The salts (A-2) can be considered as being derived from that acid.

When (A-2) is the ammonium salt, the salt is considered as being derived from ammonia ($NH_3$) or ammonia yielding compounds such as $NH_4OH$. Other ammonia yielding compounds will readily occur to the skilled person.

When (A-2) is an amine salt, the salt may be considered as being derived from amines.

The amines may be primary, secondary or tertiary amines, or mixtures thereof. Hydrocarbyl groups of the amines may be aliphatic, cycloaliphatic or aromatic. Preferably the hydrocarbyl groups are aliphatic, more preferably alkyl or alkenyl, most preferably, alkyl. When the amine is an alkylamine it is preferred that the alkyl group contains from 1 to about 24 carbon atoms.

In one preferred embodiment, the amines are primary hydrocarbyl amines containing from about 2 to about 30, more preferably about 4 to about 20, carbon atoms in the hydrocarbyl group. The hydrocarbyl group may be saturated or unsaturated. Representative examples of primary saturated amines are the alkyl amines such as methyl amine, n-butyl amine, n-hexyl amine; those known as aliphatic primary fatty amines, for example the commercially known "Armeen" primary amines (products available from Akzo Chemicals, Chicago, Ill.). Typical fatty amines include amines such as, n-octylamine, n-dodecylamine, n-tetradecylamine, n-octadecylamine (stearyl amine), octadecenyl amine (oleyl amine), etc. Also suitable are mixed fatty amines such as Akzo's Armeen-C, Armeen-O, Armeen-OD, Armeen-T, Armeen-HT, Armeen S and Armeen SD, all of which are fatty amines of varying purity.

In another preferred embodiment, the amine salts of this invention are those derived from tertiary-aliphatic primary amines having from about 4 to about 30, preferably about 6 to about 24, more preferably about 8 to about 24, carbon atoms in the aliphatic group.

Usually the tertiary aliphatic primary amines are monoamines, preferably alkyl amines represented by the formula wherein $R^{*7}$ is a hydrocarbyl group containing from one to about 30 carbon atoms. Such amines are illustrated by tertiary-butyl amine, 1-methyl-1-aminocyclohexane, tertiary-octyl primary amine, tertiary-tetradecyl primary amine, tertiary-hexadecyl primary amine, tertiary-octadecyl primary amine, tertiary- octacosanyl primary amine.

Mixtures of tertiary alkyl primary amines are also useful for the purposes of this invention. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary alkyl primary amines and methods for their preparation are known to those of ordinary skill in the art. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbyl group comprises olefinic unsaturation also are useful. Thus, the hydrocarbyl groups may contain one or more olefinic unsaturations depending on the length of the chain, usually no more than one double bond per 10 carbon atoms. Representative amines are dodecenylanine, oleylamine and linoleylamine. Such unsaturated amines are available under the Armeen tradename.

Secondary amines include dialkylamines having two of the above hydrocarbyl, preferably alkyl or alkenyl groups described for primary amines including such commercial fatty secondary amines as Armeen 2C and Armeen HT, and also mixed dialkylamines where, for example, one alkyl group is a fatty group and the other alkyl group may be a lower alkyl group (1–7 carbon atoms) such as ethyl, butyl, etc., or the other hydrocarbyl group may be an alkyl group bearing other nonreactive or polar substituents (CN, alkyl, carbalkoxy, amide, ether, thioether, halo, sulfoxide, sulfone) such that the essentially hydrocarbon character of the group is not destroyed.

Tertiary amines such as trialkyl or trialkenyl amines and those containing a mixture of alkyl and alkenyl amines are useful. The alkyl and alkenyl groups are substantially as described above for primary and secondary amines.

Other useful primary amines are the primary ether amines $R''OR'NH_2$ wherein R' is a divalent alkylene group having 2 to 6 carbon atoms and R'' is a hydrocarbyl group of about 5 to about 150 carbon atoms. These primary ether amines are generally prepared by the reaction of an alcohol R''OH wherein R'' is as defined hereinabove with an unsaturated nitrile. Typically, and for efficiency and economy, the alcohol is a linear or branched aliphatic alcohol with R'' having up to about 50 carbon atoms, preferably up to 26 carbon atoms and most preferably from 6 to 20 carbon atoms. The nitrile reactant can have from 2 to 6 carbon atoms, acrylonitrile being most preferred. Ether amines are commercially available under the name SURFAM marketed by Mars Chemical Company, Atlanta, Ga. Typical of such amines are those having from about 150 to about 400 molecular weight. Preferred etheramines are exemplified by those identified as SURFAM P14B (decyloxypropylamine), SURFAM P16A (linear $C_{16}$), SURFAM P17B (tridecyloxypropylamine). The C chain lengths (i.e., $C_{14}$, etc.) of the SURFAMS described above and used hereinafter are approximate and include the oxygen ether linkage. For example, a $C_{14}$ SURFAM amine would have the following general formula $$C_{10}H_{21}OC_3H_6NH_2$$

The amines used to form the amine salts may be hydroxyamines. In one embodiment, these hydroxyamines can be represented by the formula

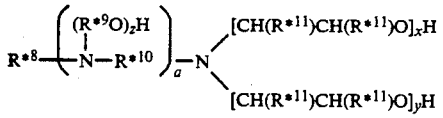

wherein $R^{*8}$ is a hydrocarbyl group generally containing from about 6 to about 30 carbon atoms, $R^{*9}$ is an ethylene or propylene group, $R^{*10}$ is an alkylene group containing up to about 5 carbon atoms, a is zero or one, each $R^{*11}$ is hydrogen or a lower alkyl group, and x, y and z are each independently integers from zero to about 10, at least one of x, y and z being at least 1.

The above hydroxyamines can be prepared by techniques well known in the art, and many such hydroxyamines are commercially available.

The useful hydroxyamines where a in the above formula is 0 include 2-hydroxyethylhexylamine, 2-hydroxyethyloleylamine, bis(2-hydroxyethyl)hexylamine, bis(2-hydroxyethyl)oleylamine, and mixtures thereof. Also included are the comparable members wherein in the above formula at least one of x and y is at least 2.

A number of hydroxyamines wherein a is zero are available from the Armak Chemical Division of Akzona, Inc., Chicago, Ill., under the general trade designation "Ethomeen" and "Propomeen". Specific examples include "Ethomeen C/15" which is an ethylene oxide condensate of a coconut fatty acid containing about 5 moles of ethylene oxide; "Ethomeen C/20" and "C/25" which also are ethylene oxide condensation products from coconut fatty acid containing about 10 and 15 moles of ethylene oxide respectively. "Propomeen 0/12" is the condensation product of one mole of oleyl amine with 2 moles propylene oxide.

Commercially available examples of alkoxylated amines where a is 1 include "Ethoduomeen T/13" and "T/20" which are ethylene oxide condensation products of N-tallow trimethylene diamine containing 3 and 10 moles of ethylene oxide per mole of diamine, respectively.

The fatty diamines include mono- or dialkyl, symmetrical or asymmetrical ethylene diamines, propane diamines (1,2, or 1,3), and polyamine analogs of the above. Suitable fatty polyamines such as those sold under the name Duomeen are commercially available diamines described in Product Data Bulletin No. 7-10$R_1$ of Armak Chemical Co., Chicago, Ill. In another embodiment, the secondary amines may be cyclic amines such as piperidine, piperazine, morpholine, etc.

In a further embodiment the sulfur- and phosphorus-containing composition is (A-3). Preferably, a and b are each 1. In one embodiment, each $R_7$, $R_8$ and $R_9$ is independently hydrogen or a hydrocarbyl group having from about 1 to about 18 carbon atoms, and a and b are each 1. Preferably, each $R_7$, $R_8$ and $R_9$ is independently hydrogen or an alkyl or an aryl group selected from the group consisting-of propyl, butyl, pentyl, hexyl, heptyl, oleyl, cresyl, or phenyl, provided at least one is said alkyl or aryl group.

In one preferred embodiment at least two of $X_9$, X10 and X11 are sulfur.

In another embodiment the sulfur- and phosphorus-containing composition may be (A-4) a mixture of two or more of the compounds represented by (A-1) to (A-3).

In another embodiment (A-1) is a thiophosphoric acid. The di-organo thiophosphoric acid materials used in this invention can be prepared by well known methods.

The O,O-di-organo dithiophosphoric acids can be prepared, for example, by reacting organic hydroxy compounds with phosphorus pentasulfide. Suitable organic hydroxy compounds include alcohols, such as, alkanols, alkanediols, cycloalkanols, alkyl- and cycloalkyl-substituted aliphatic alcohols, ether alcohols, ester alcohols and mixtures of alcohols; phenolic compounds, such as, phenol, cresol, xylenols, alkyl-substituted phenols, cycloalkyl-substituted phenols, phenyl-substituted phenols, alkoxy phenol, phenoxy phenol, naphthol, alkyl-substituted naphthols, etc. The non-benzenoid organic hydroxy compounds are generally the most useful in the preparation of the O,O-di-organo dithiophosphoric acids. A full discussion of the preparation of these compounds is in the Journal of the American Chemical Society, volume 67, (1945), page 1662.

The S, S-di-organo tetrathiophosphoric acids can be prepared by the same method described above, except that mercaptans are employed in place of the organic hydroxy compounds.

The O,S-di-organo trithiophosphoric acids can be prepared by the same manner employed in the preparation of the dithiophosphoric acids described above, except that a mixture of mercaptans and organic hydroxy compounds is reacted with phosphorus pentasulfide.

The phosphorus and sulfur containing compound (A-1) include, thiophosphoric acids including, but not limited to, dithiophosphoric as well as monothiophosphoric, thiophosphinic or thiophosphonic acids. The use of the term thiophosphoric, thiophosphonic or thiophosphinic acids is also meant to encompass monothio as well as dithio derivatives of these acids. Useful phosphorus-containing acids are described below.

In one embodiment, when a and b are 1, and one of $X_1$, $X_2$, $X_3$ or $X_4$ is sulfur and the rest are oxygen, the phosphorus-containing composition is characterized as a monothiophosphoric acid or monothiophosphate.

The monothiophosphoric acids may be characterized by one or more of the following formulae

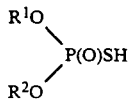

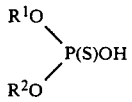

-continued

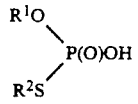

wherein $R^1$ and $R^2$ are defined as above, preferably each $R^1$ and $R^2$ is independently a hydrocarbyl group.

Monothiophosphates may be prepared by the reaction of a sulfur source such as sulfur, hydrocarbyl sulfides and polysulfides and the like and a dihydrocarbyl phosphite. The sulfur source is preferably elemental sulfur.

The preparation of monothiophosphates is disclosed in U.S. Pat. No. 4,755,311 and PCT Publication WO 87/07638 which are incorporated by reference for its disclosure of monothiophosphates, sulfur source for preparing monothiophosphates and the process for making monothiophosphates.

Monothiophosphates may be formed in the lubricant blend by adding a dihydrocarbyl phosphite to a lubricating composition containing a sulfur source. The phosphite may react with the sulfur source under blending conditions (i.e., temperatures from about 30° C. to about 100° C. or higher) to form monothiophosphate. It is also possible that monothiophosphate is formed under the conditions found in operating equipment.

In Formula I, when a and b are 1; $X_1$ and $X_2$ are oxygen; and $X_3$ and $X_4$ are sulfur, and $R_3$ is H, the phosphorus-containing composition is characterized as a dithiophosphoric acid or phosphorodithioic acid.

Dithiophosphoric acid may be characterized by the formula

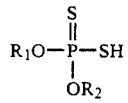

wherein $R_1$ and $R_2$ are as defined above. Preferably $R_1$ and $R_2$ are hydrocarbyl groups.

The dihydrocarbyl phosphorodithioic acids may be prepared by reaction of alcohols with $P_2S_5$ usually between the temperature of about 50° C. to about 150° C. Preparation of dithiophosphoric acids and their salts is well known to those of ordinary skill in the art.

In another embodiment, the phosphorus-containing composition is represented by Formula (I) where each $X_1$ and $X_2$ is oxygen, each $X_3$ and $X_4$ is sulfur, $R_3$ is hydrogen, and each $R_1$ and $R_2$ is independently hydrogen or

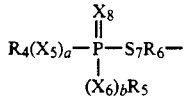

(II)

wherein the various R, a, b and X groups are as defined previously. Preferably either both $R_1$ and $R_2$ are the group of Formula II; or $R_1$ is hydrogen and $R_2$ is the group of Formula II.

Preferably, when each $R_4$ and $R_5$ is independently hydrocarbyl, they are the same as described for $R_1$ or $R_2$. Preferably, $X_5$ and $X_6$ are oxygen, and $X_7$ and $X_8$ are sulfur. Preferably $R_6$ is an arylene group, or an alkylene or alkylidene group having from 1 to about 12, more preferably from about 2 to about 6, more preferably about 3 carbon atoms. $R_6$ is preferably an ethylene, propylene, or butylene, more preferably a propylene group.

The group represented by the Formula II is derived from a compound which is the reaction of a dithiophosphoric acid with an epoxide or a glycol. The dithiophosphoric acids are those described above. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred.

The glycols may be aliphatic glycols having from 1 to about 12, preferably about 2 to about 6, more preferably 2 or 3 carbon atoms, or aromatic glycols. Aliphatic glycols include ethylene glycol, propylene glycol, triethylene glycol and the like. Aromatic glycols include hydroquinone, catechol, resorcinol, and the like.

The reaction product of the dithiophosphoric acid and the glycol or epoxide is then reacted with an inorganic phosphorus reagent such as phosphorus pentoxide, phosphorus trioxide, phosphorus tetraoxide, phosphorus acid, phosphorus halides and the like. The above reaction is known in the art and is described in U.S. Pat. No. 3,197,405 issued to LeSuer. This patent is incorporated herein by reference for its disclosure of dithiophosphoric acids, glycols, epoxides, inorganic phosphorus reagents and methods of reacting the above.

Salts of the foregoing product are also described in LeSuer (U.S. Pat. No. 3,197,405) which is incorporated herein by reference for its disclosures in this regard. Such salts are encompassed within the group of compounds (A-2).

Also included within the compounds identified as (A-1) are compounds of the formula

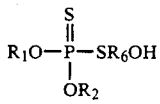

(XI)

wherein each of the groups is the same as identified hereinabove. Preferably $R_1$ and $R_2$ are each alkyl, more preferably containing from 1 to about 30 carbons, even more preferably 1 to about 18 carbons. $R_6$ is alkylene or alkylidene containing from 2 to about 28 carbons, preferably alkylene containing from 2 to about 18 carbons, more preferably 2 to about 6 carbons, even more preferably 2 to 4 carbons. Compounds of Formula (XI) may be prepared by reacting O,O-dihydrocarbyl dithiophosphates with a glycol or epoxide as discussed hereinabove. These compounds and methods for preparing same are described in U.S. Pat. No. 3,197,405 (LeSuer) and U.S. Pat. No. 3,341,633 (Asseff), both of which are hereby expressly incorporated herein by reference for relevant disclosures contained therein.

Triesters can be prepared by reacting the corresponding phosphorus and sulfur containing acid with, for example, an olefin. A detailed discussion of triesters and methods of preparing same are given in U.S. Pat. No. 2,802,856 (Norman et al) which patent is incorporated herein by reference for relevant disclosures in this regard.

Compounds (A-3) include thiophosphites and hydrogen thiophosphites. These are readily prepared by methods known in the art including reaction of mercaptans with phosphorus halides, alcohols with thiophosphorus halides and the like. Preferred are those compounds where a and b are each 1 in Formula III and wherein $R_7$, and $R_8$ are hydrocarbyl, preferably alkyl having from about 1 to about 24 carbons, more preferably from 1 to about 18 carbons, more preferably 4 to about 12 carbons, and aryl having from 6 to about 18 carbons, preferably 6 to about 12 carbons, more preferably 6 to about 10 carbons. When compound (A-3) has the Formula IV, it is preferred that $R_7$ and $R_8$ are as defined hereinabove, and $R_9$ is hydrocarbyl or hydrogen. In a preferred embodiment $R_9$ is H which is a tautomeric form of Formula III. Alternatively, in another preferred embodiment $R_9$ is hydrocarbyl, preferably alkyl or aryl as defined for $R_7$ and $R_8$ hereinabove. Preferably said phosphorus and sulfur containing composition is selected from the group consisting of (A-1) a compound represented by the formula

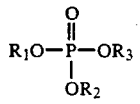
(VI)

wherein each $R_1$, $R_2$ and $R_3$ is independently hydrogen, hydrocarbyl, or

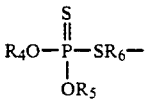
(VII)

provided at least one of $R_1$, $R_2$ and $R_3$ is

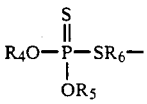
(VII)

wherein each $R_4$ and $R_5$ is independently hydrogen or hydrocarbyl, provided at least one of $R_4$ and $R_5$ is hydrocarbyl, and wherein $R_6$ is an alkylene or alkylidene group;

(A-2) an ammonium or amine salt of (A-1) provided at least $R_3$ is hydrogen;

(A-3) a compound represented by the formula

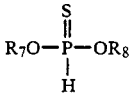
(VIII)

or

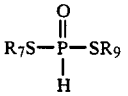
(IX)

or

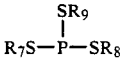
(X)

wherein each $R_7$, $R_8$ and $R_9$ is independently hydrogen or a hydrocarbyl group provided at least one is hydrocarbyl; and (A-4) mixtures of two or more of (A-1) to (A-3).

In one especially preferred embodiment the phosphorus and sulfur containing composition is (A-1), wherein at least one of $R_1$ and $R_2$ is hydrogen or

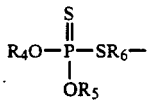
(VII)

provided at least $R_3$ is hydrogen, wherein each $R_4$ and $R_5$ is independently an alkyl group having from about 2 to about 12 carbon atoms and $R_6$ is an alkylene group having from about 2 to about 6 carbon atoms.

In another especially preferred embodiment, the phosphorus and sulfur containing composition is the amine salt (A-2) and is derived from an alkyl amine having from about 1 to about 24 carbon atoms, preferably a tertiary alkyl primary amine containing from about 10 to about 16 carbon atoms.

In a further especially preferred embodiment the phosphorus and sulfur containing composition is the compound (A-3), wherein each $R_7$, $R_8$ and $R_9$ is independently H or an alkyl group containing from 3 to about 24 carbon atoms provided at least one is said alkyl group.

In a particularly preferred embodiment, the phosphorus and sulfur containing composition is one prepared by the process comprising preparing an acidic intermediate by conducting at a temperature of from about 0° C., to about 150° C., a series of reactions comprising reacting approximately equivalent amounts of a phosphorodithioic acid having the formula

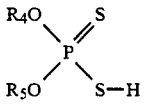
(XII)

wherein each $R_4$ and $R_5$ is independently a hydrocarbyl group with an epoxide and subsequently reacting the product obtained thereby with phosphorus pentoxide, the molar ratio, based on %OH, of the phosphorodithioic acid-epoxide reaction product to phosphorus pentoxide being within the range of from about 2:1 to about 5:1, and neutralizing at a temperature of from about 0° to 200° C., at least about 50% of the acidic mixture with an amine selected from the group consisting of a hydrocarbyl and a hydroxy-substituted hydrocarbyl amine having from about 4 to about 30 carbon atoms. Preferably the amine is a tertiary-alkyl primary amine, more preferably containing from about 10 to about 16 carbon atoms in the tertiary alkyl group.

As used herein, the term "hydrocarbyl" or "hydrocarbyl group" denotes a group having a carbon atom directly attached to the remainder of the molecule and having predominantly hydrocarbon character within the context of this invention. Thus, the term "hydrocarbyl" includes hydrocarbon, as well as substantially hydrocarbon groups. Substantially hydrocarbon describes groups, including hydrocarbon based groups, which contain non-hydrocarbon substituents, or non-carbon atoms in a ring or chain, which do not alter the predominantly hydrocarbon nature of the group.

Hydrocarbyl groups can contain up to three, preferably up to two, more preferably up to one, non-hydrocarbon substituent, or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur and nitrogen, or substituents, which include, for example, hydroxyl, halo (especially chloro and fluoro), alkyoxyl, alkyl mercapto, alkyl sulfoxy, etc.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic-substituted aromatic groups and the like as well as cyclic groups wherein the ring is competed through another portion of the molecule (that is, for example, any two indicated groups may together form an alicyclic radical);

(2) substituted hydrocarbon groups, that is, those groups containing non-hydrocarbon containing substituents which, in the context of this invention, do not significantly alter the predominantly hydrocarbon character; those skilled in the art will be aware of such groups (e.g., halo (especially chloro and fluoro), hydroxy, alkoxy, mercapto, alkylmercapto, nitro, nitroso, sulfoxy, etc.);

(3) hetero groups, that is, groups which will, while having a predominantly hydrocarbon character within the context of this invention, contain atoms other than carbon present in a ring or chain otherwise composed of carbon atoms. Suitable heteroatoms will be apparent to those of ordinary skill in the art and include, for example, sulfur, oxygen, nitrogen. Such groups as, e.g., pyridyl, furyl, thienyl, imidazolyl, etc. are representative of heteroatom containing cyclic groups.

Typically, no more than about 2, preferably no more than one, non-hydrocarbon substituent or non-carbon atom in a chain or ring will be present for every ten carbon atoms in the hydrocarbyl group. Usually, however, the hydrocarbyl groups are purely hydrocarbon and contain substantially no such non-hydrocarbon groups, substituents or heteroatoms.

Unless indicated otherwise, hydrocarbyl groups are substantially saturated. By substantially saturated it is meant that the group contains no more than one carbon-to-carbon unsaturated bond, olefinic unsaturation, for every ten carbon-to-carbon bonds present. Often, they contain no more than one carbon-to-carbon non-aromatic unsaturated bond for every 50 carbon-to-carbon bonds present. Frequently, hydrocarbyl groups are substantially free of carbon to carbon unsaturation. It is to be understood that, within the content of this invention, aromatic unsaturation is not normally considered to be olefinic unsaturation. That is, aromatic groups are not considered as having carbon-to-carbon unsaturated bonds.

The following examples illustrate types of sulfur- and phosphorus-containing compounds useful in the grease compositions of this invention. These examples are intended to be illustrative only and are not intended to limit the scope of the invention. Unless indicated otherwise, all parts are parts by weight and temperatures are in degrees Celsius.

EXAMPLE 1

O,O-di-(2-ethylhexyl) dithiophosphoric acid (354 grams) having an acid number of 154 is introduced into a stainless steel "shaker" type autoclave of 1320 ml. capacity having a thermostatically controlled heating jacket. Propylene is admitted until the pressure rises to 170 pounds per square inch at room temperature, and then the autoclave is sealed and shaken for 4 hours at 50° to 100° C. during which time the pressure rises to a maximum of 550 pounds per square inch. The pressure decreases as the reaction proceeds.

The autoclave is cooled to room temperature, the excess propylene is vented and the contents removed. The product (358 grams), a dark liquid having an acid number of 13.4 is substantially O,O-di-(2-ethylhexyl)-S-isopropyl dithiophosphate.

EXAMPLE 2

Ammonia is blown into 364 parts (1 equivalent) of the dithiophosphoric acid of Example 1 until a substantially neutral product is obtained.

EXAMPLE 3

To 1,780 grams (5 moles) of O,O-di-(2-ethylhexyl) phosphorodithioic acid, stirred at room temperature, there is added portionwise 319 grams (5.5 moles) of propylene oxide. The ensuing reaction is quite exothermic and the temperature rises to 83° C. within 15 minutes. The temperature is maintained at 90°-91° C. for three hours, whereupon an additional 29 grams (0.5 mole) of propylene oxide is added. This mixture is maintained at 90° C. for another hour, followed by stripping to a final temperature of 90° C. at 28 mm Hg pressure. The dark yellow liquid residue shows the following analysis: S, 15.4%; P, 7.4%.

Employing substantially the same procedure of Example 3 the following are reacted:

| Example | Phosphorodithioic acid | Epoxide |
|---|---|---|
| 4 | O,O'-(4-methyl-2-pentyl) | Epichlorohydrin |
| 5 | O,O'-(isopropyl) | Propylene oxide |
| 6 | O,O'-di-(2-ethylhexyl) | Styrene oxide |

EXAMPLE 7

Phosphorus pentoxide (64 grams, 0.45 mole) is added at 58° C. within a period of 45 minutes to hydroxypropyl O,O-di(4-methyl-2-pentyl) phosphorodithioate (514 grams, 1.35 moles, prepared by treating di(4-methyl-2-pentyl)-phosphoro- dithioic acid with 1.3 moles of propylene oxide at 25° C.). The mixture is heated at 75° C. for 2.5 hours, mixed with a filtering aid (diatomaceous earth), and filtered at 70° C. The filtrate is found to have, by analysis, a phosphorus content of 11.8%, a sulfur content of 15.2%, and an acid number of 87 (bromophenol blue indicator).

EXAMPLE 8

A mixture of 667 grams (4.7 moles) of phosphorus pentoxide and the hydroxypropyl O,O'-diisopropyl-phosphorodithioate prepared by the reaction of 3514 grams of diisopropyl phosphorodithioic acid with 986 grams of propylene oxide at 50° C. is heated at 85° C. for 3 hours and filtered. The filtrate has, by analysis, a phosphorus content of 15.3%, a sulfur content of 19.6%, and an acid number of 126 (bromophenol blue indicator).

EXAMPLE 9

To 217 grams (0.5 equivalent) of the acidic filtrate of Example 6 there is added at 25° to 60° C. within a period of 20 minutes, 66 grams (0.35 equivalent) of a commercial tertiary aliphatic primary amine (Primene 81-R, Rohm & Haas Co.) having an average molecular weight of 191 in which the aliphatic radical is a mixture of tertiaryalkyl radicals containing from 11 to 14 carbon atoms. The partially neutralized product has by analysis a phosphorus content of 10.2%, a nitrogen content of 1.5%, and an acid number of 26.3.

EXAMPLE 10

A portion of the filtrate of Example 7 (1752 grams) is neutralized by treatment with a stoichiometrically equivalent amount (764 grams) of the aliphatic primary azaine of Example 8 at 25°-82° C. The neutralized product has, by analysis, a phosphorus content of 9.95%, a nitrogen content of 2.724, and a sulfur content of 12.6%.

EXAMPLE 11

Phosphorus pentoxide (208 grams, 1.41 moles) is added at 50° C. to 60° C. to hydroxypropyl O,O'-diisobutylphosphorodithioate (prepared by reacting 280 grams of propylene oxide with 1184 grams of O,O'-diisobutylphosphorodithioic acid at 30° C. to 60° C.). The reaction mixture is heated to 80° C. and held at that temperature for 2 hours. To the acidic reaction mixture there is added a stoichiometrically equivalent amount (384 grams) of the commercial aliphatic primary amine of Example 8 at 30° C. to 60° C. The product is filtered. The filtrate has, by analysis a phosphorus content of 9.31%, a sulfur content of 11.374, a nitrogen content of 2.50%, and a base number of 6.9 (bromphenol blue indicator).

EXAMPLE 12

To 400 parts of O,O'di-(isoctyl) phosphorodithioic acid is added 308 parts of oleyl amine (Armeen O- Armak).

EXAMPLE 13

Butyl phosphonic dichloride (175 parts, 1 mole) is reacted with a mixture of 146 parts, 1 mole, 1-octane thiol and 74 parts, 1 mole, 1-butanol.

As mentioned hereinabove, the sulfur- and phosphorus-containing compounds which provide increased thickening of metal soap thickened greases are used in minor amounts effective to increase the dropping point of the base grease by at least 30° C., usually amounts ranging from about 0.254 to about 10% by weight of the total grease composition.

Preferred minimum amounts of sulfur and phosphorus containing compound to employ depend to some extent upon the additive. When the sulfur and phosphorus containing additive is (A-1) it is preferred to use at least about 0.754 by weight. The same is true when the additive is (A-2) but the preferred minimum amount of (A-3) is about 0.25% by weight.

It generally is not necessary to use more than about 10% by weight of the sulfur and phosphorus containing compound since no additional benefit is obtained and often, deteriorating performance with respect to the dropping point and other characteristics of the grease is observed above this treating level. More often no more than,about 5% frequently no more than about 2% of the sulfur and phosphorus containing compound is employed. Often 1% by weight is sufficient to provide a 30° C. increase in dropping point.

Thus, it is preferred to use the minimum amount of sulfur and phosphorus containing additive consistent with attaining the desired dropping point elevation of at least 30° C.

The sulfur- phosphorus- containing composition may be present during grease formation, i.e., during formation of the soap thickener, or may be added after the base grease has been prepared. In many cases it is preferred to add the sulfur- and phosphorus- containing composition to the preformed base grease since the sulfur- phosphorus-compositions may be adversely affected during preparation of metal soap thickeners.

Other additives may be incorporated into the base grease to improve performance of the grease as a lubricant. Such other additives including corrosion inhibitors, antioxidants, extreme pressure additives and others useful for improving specific performance characteristics of a base grease, are well-known and will readily occur to those skilled in the art. Oftentimes these additives have an adverse effect on the dropping point of the grease. Use of the sulfur and phosphorus containing compounds together with these additives often compensates for this effect.

The following examples illustrate grease compositions of this invention. It is to be understood that these examples are intended to illustrate the invention and are not intended to be limiting in any way. Dropping points are determined using ASTM Procedure D-2265. All amounts are unless indicated otherwise, on an oil free basis and are by weight.

EXAMPLE A

A lithium 12-hydroxystearate thickened base grease showed dropping point of 210° C. This is a typical simple lithium salt thickened base grease.

EXAMPLE B

A grease composition is prepared by blending 0.75% by weight of an O,O'-di-(2-ethylhexyl) dithiophosphoric acid prepared by reacting about-4 moles 2-ethylhexanol with 1 mole $P_2S_5$ into the grease of Example A. This grease has a dropping point of 277° C.

EXAMPLE C

A grease composition as in Example B is prepared containing 0.85% of the acid. The dropping point is 275° C.

EXAMPLE D

A grease composition is prepared as in Example B except that the acid is O,O'-di-(isoctyl) dithiophosphoric acid prepared by reacting about 4 moles isooctanol with 1 mole $P_2S_5$. The grease has a dropping point of 280° C.

EXAMPLE E

A grease composition as in Example D is prepared containing 0.85% of the acid. The dropping point is 297° C.

EXAMPLES F-J

Grease compositions are prepared by blending into a lithium 12-hydroxy stearate base grease the indicated percentages by weight of the product obtained by reacting 1000 parts of O,O'-(di)-methylamyl dithiophosphoric acid prepared by reacting about 4 moles methyl amyl alcohol with 1 mole of $P_2S_5$ with 183 parts of propylene oxide, reacting the product obtained thereby with 144 parts of $P_2O_5$ and neutralizing the acidic product obtained thereby with 584 parts of Primene 81-R.

| Example | % by weight additive | Dropping Point (°C.) |
|---|---|---|
| F | 0.5 | 210° C. |
| G | 0.75 | 267° C. |
| H | 0.85 | 262° C. |
| I | 1.0 | 257° C. |
| J | 1.5 | 267° C. |

For comparative purposes, grease compositions are prepared employing conventional phosphorous containing additives but which are substantially free of sulfur.

EXAMPLES K-L

Grease compositions are prepared by blending into a lithium 12-hydroxystearate base grease having a dropping point of 207° C. the indicated percentages of a mixed phosphoric acid salt prepared by reacting 3 moles (based on OH) of CO1418 alcohol (a primary alcohol containing a mixture of $C_{14}$, $C_{16}$ and $C_{18}$ carbon chains) with 1 mole $P_2O_5$ then reacting the acidic product obtained with 1.13 equivalents of Primene 81-R per equivalent of strong acid.

| Example | % by weight additive | Dropping Point (°C.) |
|---|---|---|
| K | 1.0 | 204° C. |
| L | 1.4 | 198° C. |

EXAMPLES M-O

Grease compositions are prepared by blending into a lithium 12-hydroxystearate base grease the indicated percentages of dibutylhydrogen phosphite ((Butyl-0)$_2$PHO).

| Example | % by weight additive | Dropping Point (°C.) |
|---|---|---|
| M | 0.35 | 200° C. |
| N | 0.45 | 202° C. |
| O | 0.55 | 197° C. |

EXAMPLES P-T

Examples F-J are repeated replacing the lithium 12-hydroxy stearate base grease with the corresponding calcium soap thickened base grease.

EXAMPLES U-V

Examples C and H are repeated replacing the lithium 12-hydroxy stearate base grease with a sodium tallowate thickened base grease.

From the foregoing Examples it is apparent that the use of certain sulfur and phosphorus containing compositions at minimum levels provides enhanced thermal stability as evidenced by increased dropping points compared to the base greases without additive. It is also apparent that phosphorus containing compounds that are substantially free of sulfur do not provide any increase in dropping point.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An improved grease compositions substantially free of boron or boron-containing compounds, comprising a major amount of an oil based simple metal soap thickened base grease and a minor amount of at least one phosphorus and sulfur containing composition sufficient to increase the dropping point of the base grease, as determined by ASTM procedure D-2265, by at least 30° C., said phosphorus and sulfur containing composition selected from the group consisting of (A-1) a compound represented by the formula

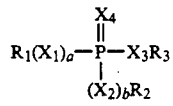

(I)

wherein each $X_1$, $X_2$, $X_3$ and $X_4$ is independently oxygen or sulfur provided at least one is sulfur; each a and b is independently 0 or 1; and wherein each $R_1$, $R_2$ and $R_3$ is independently hydrogen, hydrocarbyl, a group of the formula

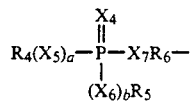

(II)

wherein each $R_4$ and $R_5$ is independently hydrogen or hydrocarbyl, provided at least one of $R_4$ and $R_5$ is hydrocarbyl, $R_6$ is an alkylene or alkylidene group, each a and b is independently 0 or 1, and each $X_5$, $X_6$, $X_7$ and $X_8$ is independently oxygen or sulfur;

or a group of the formula $R_6OH$, wherein $R_6$ is an alkylene or alkylindene group;

(A-2) an amine or an ammonium salt of (A-1) when at least $R_3$ is hydrogen;

(A-3) a compound represented by the formula

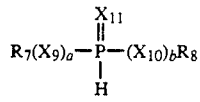

(III)

or

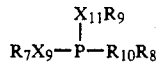

(IV)

wherein each $R_7$, $R_8$ and $R_9$ is independently hydrogen or a hydrocarbyl group provided at least one is hydrocarbyl, each $X_9$, $X_{10}$ and $X_{11}$ is independently oxygen or sulfur provided at least one is sulfur, and each a and b is independently 0 or 1; and (A-4) mixtures of two or more of (A-1) to (A-3) thereof.

2. The grease composition of claim 1, wherein the metal soap is an alkali, an alkaline earth or an aluminum metal soap.

3. The grease composition of claim 2, wherein the metal soap is an alkali metal soap.

4. The grease composition of claim 2, wherein the metal soap is an alkaline earth metal soap.

5. The grease composition of claim 3, wherein the metal soap is a sodium or lithium soap.

6. The grease composition of claim 4, wherein the metal soap is a calcium or magnesium soap.

7. The grease composition of claim 1, wherein the metal soap is a fatty acid metal salt.

8. The grease composition of claim 7, wherein the fatty acid is a $C_8$ to $C_{24}$ mono-carboxylic acid.

9. The grease composition of claim 7, wherein the fatty acid is hydroxy-substituted.

10. The grease composition of claim 7, wherein the metal soap is a 12-hydroxy stearate.

11. The grease composition of claim 1, wherein the phosphorus and sulfur containing composition is (A-1) and a and b are each 1.

12. The grease composition of claim 11, wherein $R_1$ and $R_2$ are each independently hydrocarbyl groups containing from 1 to about 30 carbon atoms and $R_3$ is H or a hydrocarbyl group containing from 1 to about 30 carbon atoms.

13. The grease composition of claim 12, wherein each of $R_1$, $R_2$ and $R_3$ is independently an alkyl group containing from about 1 to about 18 carbon atoms or an aryl group containing from about 6 to about 18 carbon atoms.

14. The grease composition of claim 13, wherein $R_1$, $R_2$ and $R_3$ are independently butyl, hexyl, heptyl, octyl, oleyl or cresyl groups.

15. The grease composition of claim 12, wherein $R_3$ is H.

16. The grease composition of claim 15, wherein each of $R_1$ and $R_2$ is independently an alkyl group containing from 1 to about 18 carbon atoms or an aryl group containing from about 6 to about 18 carbon atoms.

17. The grease composition of claim 16, wherein Rand $R_2$ are each independently butyl, hexyl, heptyl, octyl, oleyl or cresyl groups.

18. The grease composition of claim 12, wherein one of $X_1$, $X_2$ and $X_3$ is sulfur and the rest are oxygen.

19. The grease composition of claim 11, wherein each $R_1$, $R_2$ and $R_3$ is independently hydrogen or

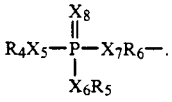

(V).

20. The grease composition of claim 19, wherein $R_3$ is hydrogen and each $R_1$ and $R_2$ is independently hydrogen or

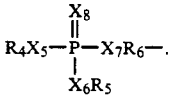

(V)

21. The grease composition of claim 20, wherein $X_5$ and $X_6$ are oxygen and wherein $X_7$ and $X_8$ are sulfur.

22. The grease composition of claim 20, wherein one of $X_5$, $X_6$, $X_7$ and $X_8$ is sulfur and the rest are oxygen.

23. The grease composition of claim 20, wherein each of $X_3$ and $X_4$ is oxygen.

24. The grease composition of claim 23, wherein $X_2$ is oxygen.

25. The grease composition of claim 11, wherein each of $R_1$ and $R_2$ is independently hydrocarbyl having from 1 to about 30 carbon atoms and $R_3$ is $R_6OH$ wherein $R_6$ is an alkylene group containing from 2 to about 28 carbon atoms.

26. The grease composition of claim 25, wherein one of $X_1$, $X_2$, $X_3$ and $X_4$ is sulfur and the rest are oxygen.

27. The grease composition of claim 25, wherein $X_3$ and $X_4$ are sulfur and $X_1$ and $X_2$ are oxygen.

28. The grease composition of claim 1, wherein the phosphorus and sulfur containing composition is the ammonium or amine salt (A-2) and a and b are each 1.

29. The grease composition of claim 28, wherein, (A-2) is an ammonium salt.

30. The grease composition of claim 28, wherein (A-2) is an amine salt.

31. The grease composition of claim 30, wherein the salt is formed from an hydroxyamine, an ether amine or an alkyl amine having from 1 to about 24 carbon atoms.

32. The grease composition of claim 31, wherein the alkyl amine is a tertiary alkyl primary amine.

33. The grease composition of claim 30, wherein the amine is an alkyl amine containing from 4 to about 18 carbons.

34. The grease composition of claim 30, wherein the amine salt is a fatty amine salt wherein the fatty amine contains from 8 to about 18 carbon atoms.

35. The grease composition of claim 1, wherein the phosphorus and sulfur containing composition is the compound (A-3).

36. The grease composition of claim 35, wherein each $R_7$, $R_8$ and $R_9$ is independently hydrogen or a hydrocarbyl group having from about 1 to about 18 carbon atoms, and a and b are each 1.

37. The grease composition of claim 35, wherein each $R_7$, $R_8$ and $R_9$ is independently hydrogen or an alkyl or an aryl group selected from the group consisting of propyl, butyl, pentyl, hexyl, heptyl, oleyl, cresyl, or phenyl provided at least one is said alkyl or aryl group.

38. The grease composition of claim 36, wherein at least two of $X_9$, $X_{10}$ and $X_{11}$ are sulfur.

39. An improved grease composition, substantially free of boron, and boron containing compounds, comprising a major amount of an oil based simple metal soap thickened base grease and a minor amount of at least one phosphorus and sulfur containing composition sufficient to increase the dropping point of the base grease as determined by ASTM procedure D-2265 by at least 30° C., wherein said phosphorus and sulfur containing composition is selected from the group consisting of (A-1) a compound represented by the formula

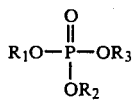

(VI)

wherein each $R_1$, $R_2$ and $R_3$ is independently hydrogen, hydrocarbyl, or

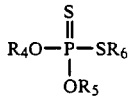

(VII)

provided at least one of $R_1$, $R_2$ and $R_3$ is

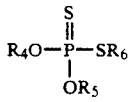

(VII)

wherein each $R_4$ and $R_5$ is independently hydrogen or hydrocarbyl, provided at least one of $R_4$ and $R_5$ is hydrocarbyl, and wherein $R_6$ is an alkylene or alkylidene group;

(A-2) an ammonium or amine salt of (A-1) provided at least $R_3$ is hydrogen;

(A-3) a compound represented by the formula

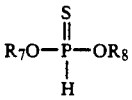

(VIII)

or

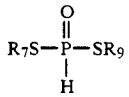

(IX)

or

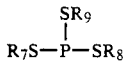

(X)

wherein each $R_7$, $R_8$ and $R_9$ is independently hydrogen or a hydrocarbyl group provided at least one is hydrocarbyl; and (A-4) mixtures of two or more of (A-1) to (A-3).

40. The grease composition of claim 39, wherein the phosphorus and sulfur containing composition is (A-1), wherein at least one of $R_1$ and $R_2$ is hydrogen or

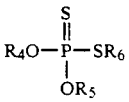

(VII)

provided at least $R_3$ is hydrogen, wherein each $R_4$ and $R_5$ is independently an alkyl group having from about 2 to about 12 carbon atoms and $R_6$ is an alkylene group having from about 2 to about 6 carbon atoms.

41. The grease composition of claim 39, wherein the phosphorus and sulfur containing composition is the amine salt (A-2) and is derived from an alkyl amine having from about 1 to about 24 carbon atoms.

42. The grease composition of claim 41, wherein the amine is a tertiary alkyl primary amine containing from about 10 to about 16 carbon atoms.

43. The grease composition of claim 39, wherein the phosphorus and sulfur containing composition is the compound (A-3), wherein each $R_7$, $R_8$ and $R_9$ is independently H or an alkyl group containing from 3 to about 24 carbon atoms provided at least one is said alkyl group.

44. The grease composition of claim 1, wherein the phosphorus and sulfur containing composition is (A-1) having the formula

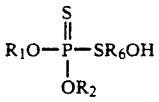

(VII)

wherein each of $R_1$ and $R_2$ is alkyl containing from 1 to about 18 carbon atoms and $R_6$ is an alkylene or alkylidene group containing from 2 to about 18 carbon atoms.

45. An improved grease composition, substantially free of boron and boron containing compounds, comprising a major amount of an oil based simple metal soap thickened base grease and a minor amount of at least one phosphorus and sulfur containing composition sufficient to increase the dropping point of the base grease as determined by ASTM Procedure D-2265 by at least 30° C., said phosphorus and sulfur containing composition prepared by the process comprising preparing an acidic intermediate by conducting at a temperature of from about 0° C., to about 150° C., a series of reactions comprising reacting approximately equivalent amounts of a phosphorodithioic acid having the formula

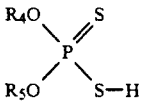

(XII)

wherein each $R_4$ and $R_5$ is independently a hydrocarbyl group and an epoxide and subsequently reacting the product obtained thereby with phosphorus pentoxide, the molar ratio of the phosphorodithioic acid-epoxide reaction product to phosphorus pentoxide being within the range of from about 1 to about 5:1, and neutralizing at a temperature of from about 0° to 200° C., at least about 50% of the acidic mixture with an amine selected from the group consisting of a hydrocarbyl and a hydroxy-substituted hydrocarbyl amine having from about 4 to about 30 carbon atoms.

46. The grease composition of claim 45, wherein the amine is a tertiary-alkyl primary amine.

47. The grease composition of claim 46, wherein the amine has from about 10 to about 16 carbon atoms.

48. The grease composition of claim I comprising at least about 0.25% by weight of the phosphorus and sulfur containing composition.

49. The grease composition of claim 11 comprising at least about 0.75% by weight of (A-1).

50. The grease composition of claim 29 comprising at least about 0.75% by weight of (A-2).

51. The grease composition of claim 36 comprising at least about 0.25% by weight of (A-3).

52. The grease composition of claim 45 comprising at least about 0.75% by weight of the sulfur and phosphorus containing composition.

53. A method for increasing the dropping point of an oil based simple metal soap thickened base grease by at least about 30° C. as measured by ASTM Procedure D-2265 comprising-adding to the base grease a minor amount, based on the total weight of the grease composition, sufficient to increase the dropping point of said base grease by at least 30° C., of a sulfur and phosphorus containing composition according to claim 1.

* * * * *